US011238795B2

(12) United States Patent
He et al.

(10) Patent No.: US 11,238,795 B2
(45) Date of Patent: Feb. 1, 2022

(54) METHOD FOR CONTROLLING CHARGING TIME OF DISPLAY PANEL, AND ELECTRONIC APPARATUS

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Min He, Beijing (CN); Song Meng, Beijing (CN); Can Yuan, Beijing (CN); Chun Cao, Beijing (CN); Meng Li, Beijing (CN); Yongchao Huang, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/259,702

(22) PCT Filed: Jun. 24, 2020

(86) PCT No.: PCT/CN2020/097952
§ 371 (c)(1),
(2) Date: Jan. 12, 2021

(87) PCT Pub. No.: WO2020/259545
PCT Pub. Date: Dec. 30, 2020

(65) Prior Publication Data

US 2021/0335245 A1 Oct. 28, 2021

(30) Foreign Application Priority Data

Jun. 26, 2019 (CN) ..... 201910561508.1

(51) Int. Cl.
*G09G 3/3233* (2016.01)
*G09G 3/3275* (2016.01)
*G09G 3/32* (2016.01)

(52) U.S. Cl.
CPC ..... *G09G 3/3233* (2013.01); *G09G 3/32* (2013.01); *G09G 3/3275* (2013.01);
(Continued)

(58) Field of Classification Search
None
See application file for complete search history.

(56) References Cited

U.S. PATENT DOCUMENTS

2003/0057851 A1 3/2003 Roh et al.
2013/0162617 A1* 6/2013 Yoon ..... G09G 3/3233 345/211

(Continued)

FOREIGN PATENT DOCUMENTS

CN 110111740 8/2019

OTHER PUBLICATIONS

Wang et al., "Analyses of Several Current Programmed AM OLED Pixel Circuits and Their Current Scaling Ratio," (w/ English Translation) *Chinese Journal of Liquid Crystals and Displays*, vol. 24, No. 2, Apr. 4, 2009, 12 pages.

(Continued)

*Primary Examiner* — Christopher J Kohlman
(74) *Attorney, Agent, or Firm* — Dority & Manning, P.A.

(57) ABSTRACT

A method for controlling a charging time of a display panel includes: during $t_0+k\Delta t$ in a (k+1)-th blanking time, writing a data voltage to a gate of a driving transistor, and detecting a voltage $V_{k_(j,i)}$ of a second electrode of the driving transistor; during a $t_0+(k+r)\Delta t$ in a (k+1+r)-th blanking time, writing the data voltage to the gate of the driving transistor, and detecting a voltage $V_{k+1_(j,i)}$ of the second electrode of (Continued)

the driving transistor; determining whether $\Delta V_{j,i}=V_{k+1_ji}-V_{k_ji}$ is less than or equal to a target voltage difference VT; if $\Delta V_{j,i}\leq VT$, taking the $T=t_0+k\Delta t$ as an expected charging time of a sub-pixel; if $\Delta V_{j,i}>VT$, cyclically performing the charging step described above to obtain $\Delta V_{j,i}=V_{k+p+1_(j,i)}-V_{k+p_(j,i)}$, and comparing $\Delta V_{j,i}$ with the target voltage difference VT, until $\Delta V_{j,i}\leq VT$, taking $t_0+(k+p+r-1)\Delta t$ as the expected charging time of the sub-pixel. p is taken from 1, and increases by 1 for each cycle.

15 Claims, 10 Drawing Sheets

(52) U.S. Cl.
CPC ..... *G09G 2300/0842* (2013.01); *G09G 2310/0251* (2013.01); *G09G 2310/08* (2013.01)

(56) References Cited

U.S. PATENT DOCUMENTS

2014/0152633 A1 6/2014 Park et al.
2014/0347332 A1* 11/2014 Lee ..... G09G 3/3233 345/204
2015/0138179 A1 5/2015 Park
2017/0004764 A1 1/2017 Kim et al.
2017/0316731 A1 11/2017 Cho et al.
2019/0147797 A1* 5/2019 Yuan ..... G09G 3/20 345/76
2019/0304362 A1* 10/2019 Yuan ..... G09G 3/3233
2019/0385525 A1* 12/2019 Jin ..... G09G 3/3208
2020/0168150 A1* 5/2020 Lin ..... G09G 3/3225

OTHER PUBLICATIONS

Wang et al., "Investigation of $V_{TH}$ Detection Methods for AMOLED Pixel Circuit Design with IGZO-TFT," (w/ English Translation), *Chinese Journal of Luminescence*, vol. 37, No. 5, May 5, 2016, 18 pages.
Chinese Office Action (w/ English Translation) for corresponding Chinese Application No. 201910561508.1, 13 pages.
PCT international Search Report (w/ English translation) for corresponding PCT Application No. PCT/CN2020/097952, dated Sep. 23, 2020, 6 pages.

* cited by examiner

METHOD FOR CONTROLLING CHARGING TIME OF DISPLAY PANEL, AND ELECTRONIC APPARATUS

CROSS-REFERENCE TO RELATED APPLICATIONS

This application is a national phase entry under 35 USC 371 of International Patent Application No. PCT/CN2020/097952 filed on Jun. 24, 2020, which claims priority to Chinese Patent Application No. 201910561508.1, filed on Jun. 26, 2019, which are incorporated herein by reference in their entirety.

TECHNICAL FIELD

The present disclosure relates to the field of display technologies, and in particular, to a method for controlling a charging time of a display panel, and an electronic apparatus.

BACKGROUND

Organic light-emitting diodes (OLED), as current-driven light-emitting devices, have been increasingly used in the field of high-performance display due to their characteristics, such as self-luminescence, fast response, wide viewing angle, and an ability to be fabricated on a flexible substrate.

In the capacitive touch screens, a detection of a touch position is made with a touch structure carried by the screen. According to different carrying forms of the touch structure, the capacitive touch screens may include add-on touch screens, on-cell touch screens, and in-cell touch screens. For the in-cell touch screen, the touch structure is embedded in the display screen, which can reduce a thickness of an entire display module and a manufacturing cost.

SUMMARY

In an aspect, in embodiments of the present disclosure, a method for controlling a charging time of a display panel is provided. The display panel includes sub-pixels arranged in M rows and N columns. Each sub-pixel includes a light-emitting device and a driving transistor. A second electrode of the driving transistor is electrically connected to an anode of the light-emitting device. $M \geq 1$, $N \geq 1$, and M and N are positive integers. The method includes: during a (k+1)-th blanking time, setting a charging time of a sub-pixel in a j-th row and an i-th column to be $T=t_0+k\Delta t$, writing a data voltage to a gate of the driving transistor in the sub-pixel in the j-th row and the i-th column, and at an end of the charging time $t_0+k\Delta t$, detecting a voltage $V_{k_(j,i)}$ of the second electrode of the driving transistor, $t_0$ being an initial charging time, and to being less than a saturation charging time of the driving transistor, and $1 \leq j \leq M$, $1 \leq i \leq N$, $k \geq 0$, j, i and k being integers; during a (k+1+r)-th blanking time, setting the charging time of the sub-pixel in the j-th row and the i-th column to be $T=t_0+(k+r)\Delta t$, writing the data voltage to the gate of the driving transistor in the sub-pixel in the j-th row and the i-th column, and at an end of the charging time $t_0+(k+r)\Delta t$, detecting a voltage $V_{k+1_(j,i)}$ of the second electrode of the driving transistor, $r \geq 1$, r being a positive integer; obtaining a voltage difference $\Delta V_{j,i}=V_{k+1_(j,i)}-V_{k_(j,i)}$ of the second electrode of the driving transistor in the sub-pixel in the j-th row and the i-th column between two adjacent blanking times, and comparing the voltage difference $\Delta V_{j,i}$ with a target voltage difference VT; if $\Delta V_{j,i} \leq VT$, taking $t_0+k\Delta t$ as an expected charging time of the sub-pixel in the j-th row and the i-th column; if $\Delta V_{j,i} > VT$, cyclically performing: assigning k+p to k, detecting a voltage $V_{k+p+1_(j,i)}$ of the second electrode of the driving transistor in the sub-pixel in the j-th row and the i-th column, obtaining $\Delta V_{j,i}=V_{k+p+1_(j,i)}-V_{k+p_(j,i)}$, and comparing $\Delta V_{j,i}$ and the target voltage difference VT, until $\Delta V_{j,i} \leq VT$, and taking $t_0+(k+p+r-1)\Delta t$ as the expected charging time of the sub-pixel in the j-th row and the i-th column. p is taken from 1 and increases by 1 for each cycle.

In some embodiments, the method further includes: during the (k+1)-th blanking time, repeatedly performing: writing the data voltage to the gate of the driving transistor in the sub-pixel in the j-th row and an (i+x)-th column and at an end of the charging time $t_0+k\Delta t$, detecting a voltage $V_{k_(j,i+x)}$ of the second electrode of the driving transistor in the sub-pixel in the j-th row and the (i+x)-th column, in which x varies with each repetition, to obtain a voltage of the second electrode of the driving transistor in each sub-pixel in the j-th row during the (k+1)-th blanking time, x being an integer not equal to 0; during the (k+1+r)-th blanking time, repeatedly performing: writing the data voltage to the gate of the driving transistor in the sub-pixel in the j-th row and the (i+x)-th column and at an end of the charging time $t_0+(k+r)\Delta t$, detecting a voltage $V_{k+1_(j,i+x)}$ of the second electrode of the driving transistor in the sub-pixel in the j-th row and the (i+x)-th column, in which x varies with each repetition to obtain a voltage of the second electrode of the driving transistor in each sub-pixel in the j-th row during the (k+1+r)-th blanking time; repeatedly performing: obtaining a voltage difference $\Delta V_{j,i+x}=V_{k+1_(j,i+x)}-V_{k_(j,i+x)}$ of the second electrode of the driving transistor in the sub-pixel in the j-th row and the (i+x)-th column between two adjacent blanking times, comparing the voltage difference $\Delta V_{j,i+x}$ with the target voltage difference VT, if $\Delta V_{j,i+x} \leq VT$, taking $t_0+k\Delta t$ as an expected charging time of the sub-pixel in the j-th row and (i+x)-th column; if $\Delta V_{j,i+x} > VT$, cyclically performing: assigning k+p to k, detecting a voltage $V_{k+p+1_(j,i+x)}$ of the second electrode of the driving transistor in the sub-pixel in the j-th row and the (i+x)-th column, obtaining $\Delta V_{j,i+x}=V_{k+p+1_(j,i+x)}-V_{k+p_(j,i+x)}$, and comparing $\Delta V_{j,i+x}$ with the target voltage difference VT, until $\Delta V_{j,i+x} \leq VT$, taking $t_0+(k+p+r-1)\Delta t$ as the expected charging time of the sub-pixel in the j-th row and the (i+x)-th column, in which p is taken from 1, and increases by 1 for each cycle and x varies with each repetition to obtain expected charging times of all sub-pixels in the j-th row; and obtaining a maximum value $T_{jmax}$ of the expected charging times of all sub-pixels in the j-th row as an expected charging time for all sub-pixels in the j-th row.

In some embodiments, the method further includes: when obtaining the expected charging times of all sub-pixels in the j-th row, obtaining expected charging times of all sub-pixels in each of M rows except for the j-th row; and for each of the M rows except for the j-th row, obtaining a maximum value of expected charging times of all sub-pixels in the row as an expected charging time for all sub-pixels in the row.

In some embodiments, the method further includes: during the (k+1)-th blanking time, obtaining a voltage of a second electrode of a driving transistor in each sub-pixel in each of 1st row to q-th row among the M rows except for the j-th row, $j \leq q < M$, and $q \geq 0$, and q being a positive integer; during the (k+1+r)-th blanking time, obtaining a voltage of the second electrode of the driving transistor in each sub-pixel in each of the 1st row to the q-th row among the M rows except for the j-th row; for each sub-pixel in each of the 1st row to the q-th row among the M rows except for the j-th row, obtaining an expected charging time of the sub-pixel; obtaining a maximum value of the expected charging times of all sub-pixels in each of the 1st row to the q-th row except for the j-th row as an expected charging time for all sub-pixels in the row; during a (k+2)-th blanking time, obtaining a voltage of a second electrode of a driving transistor in each sub-pixel in each of (q+1)-th row to M-th row; during a (k+2+r)-th blanking time, obtaining a voltage of the second electrode of the driving transistor in each sub-pixel in each of the (q+1)-th row to the M-th row; obtaining an expected charging time of the sub-pixel for each sub-pixel in each of the (q+1)-th row to the M-th row; obtaining a maximum value of the expected charging times of all sub-pixels in each of the (q+1)-th row to the M-th row as an expected charging time for all sub-pixels in the row.

In some embodiments, the method further includes: storing an expected charging time for the sub-pixels in each row; during a blanking time, obtaining at least the expected charging time $T_{jmax}$ for the sub-pixels in the j-th row, and at a beginning of $T_{jmax}$, inputting the data voltage to the gate of the driving transistor in each sub-pixel in the j-th row.

In some embodiments, the method further includes: during each blanking time for detecting the voltage of the second electrode of the driving transistor, and before the charging time T, writing a reset voltage to the second electrode of the driving transistor.

In some embodiments, the target voltage difference VT is 0 to 3 V.

In another aspect, in the embodiments of the present disclosure, a non-transitory computer readable medium having computer program stored therein is provided. The method as described above is implemented when the computer program is executed.

In yet another aspect, in the embodiments of the present disclosure, an electronic apparatus is provided. The electronic apparatus includes a processor and a memory. The memory is configured to store one or more programs. The processor is configured to execute the one or more programs. When the one or more programs are executed by the processor, the method as described above is implemented.

In some embodiments, the electronic apparatus further includes a display panel. The display panel includes sub-pixels arranged in M rows and N columns, M≥1, N≥1, and M and N are positive integers. Each sub-pixel includes a light-emitting device, a driving transistor, a sensing transistor, a sensing signal line, and a sensing capacitor. A second electrode of the driving transistor is electrically connected to an anode of the light-emitting device. A first electrode of the sensing transistor is electrically connected to the second electrode of the driving transistor. The sensing signal line is electrically connected to a second electrode of the sensing transistor. One end of the sensing capacitor is electrically connected to the sensing signal line, and another end of the sensing capacitor is grounded. The electronic apparatus further includes a source driving chip. The source driving chip is electrically connected to the sensing signal line and the processor. The source driving chip is configured to detect a voltage of the second electrode of the driving transistor during a blanking time according to a capacitance of the sensing capacitor at an end of an expected charging time.

In some embodiments, the sub-pixel further includes a writing transistor and a storage capacitor. A first electrode of the writing transistor is configured to receive a data voltage, and a second electrode of the writing transistor is electrically connected to a gate of the driving transistor. An end of the storage capacitor is electrically connected to the gate of the driving transistor, and another end of the storage capacitor is electrically connected to the second electrode of the driving transistor.

In some embodiments, the sub-pixel further includes a reset switch. One end of the reset switch is electrically connected to the sensing signal line, and another end of the reset switch is electrically connected to a reset voltage terminal. The reset voltage terminal is configured to output a reset voltage.

In some embodiments, the sub-pixels in a same column are connected to a same sensing signal line.

In some embodiments, the light-emitting device is an organic light-emitting diode or a micro light-emitting diode.

BRIEF DESCRIPTION OF THE DRAWINGS

In order to explain technical solutions in the embodiments of the present disclosure more clearly, the accompanying drawings used in some embodiments of the present disclosure will be explained below briefly. However, the accompanying drawings to be described below are merely accompanying drawings of some embodiments of the present disclosure, and a person of ordinary skill in the art can obtain other drawings according to these drawings. In addition, the accompanying drawings to be described below may be regarded as schematic diagrams, and are not limitations on an actual size of a product, an actual process of a method and an actual timing of a signal that are involved in the embodiments of the present disclosure.

DETAILED DESCRIPTION

Technical solutions Technical solutions in some embodiments of the present disclosure will be described below clearly and completely in combination with the accompanying drawings. Obviously, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, throughout the specification and the claims, the term "comprise" and other forms thereof such as the third-person singular form "comprises" and the present participle form "comprising" are construed as open and inclusive, i.e., "included, but not limited to". In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, specific features, structures, materials or characteristics may be included in any one or more embodiments/examples in any suitable manner.

The terms such as "first" and "second" are only used for descriptive purposes, and are not to be construed as indicating or implying the relative importance or implicitly indicating the number of indicated technical features below. Thus, features defined by "first" and "second" may explicitly or implicitly include one or more of the features. In the description of the embodiments of the present disclosure, the term "a plurality of" means two or more unless otherwise specified.

In the description of some embodiments, the term "connected" and its extensions may be used. For example, some embodiments may be described using the term "connected" to indicate that two or more elements are in direct physical contact or electrical contact with each other. However, the term "connected" may also mean that two or more components are not in direct contact with each other but still cooperate or interact with each other. The embodiments disclosed herein are not necessarily limited to the content herein.

In some embodiments of the present disclosure, an electronic apparatus is provided. The electronic apparatus is, for example, a computer, a TV, a mobile phone, a tablet computer, a personal digital assistant (PDA), a vehicle-mounted computer, etc. The embodiments of the present disclosure do not particularly limit a specific form of the electronic apparatus.

Figure 1A:
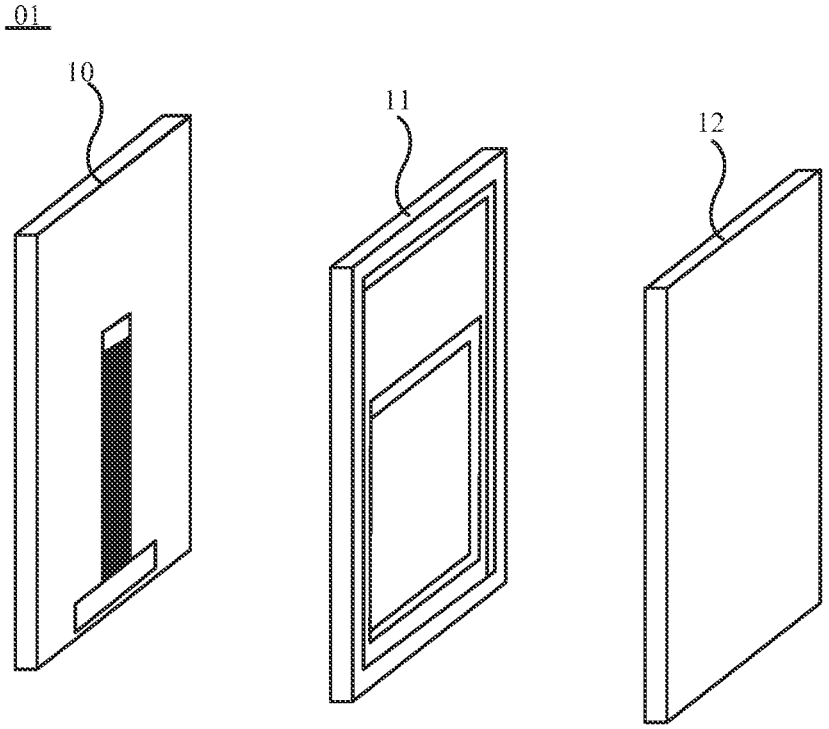
FIG. 1A is a schematic diagram showing a structure of an electronic apparatus, according to some embodiments of the present disclosure.

As shown in FIG. 1A, the electronic apparatus 01 mainly includes a display panel 10, a frame 11 and a housing 12. The display panel 10 is installed on the frame 11, and the frame 11 is connected to the housing 12. The display panel 10 has a display surface and a back surface away from the display surface.

Figure 1B:
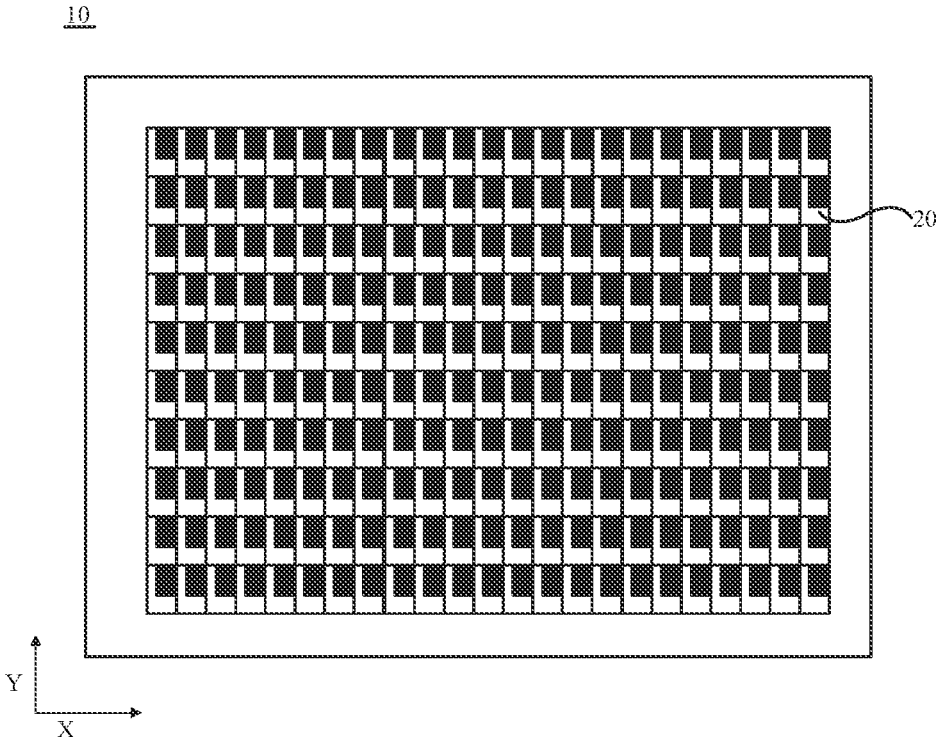
FIG. 1B is a schematic diagram showing a structure of a display panel in FIG. 1A.

In the embodiments of the present disclosure, as shown in FIG. 1B, the display panel 10 includes sub-pixels 20 arranged in M rows and N columns. Here, M≥1, N≥1, and M and N are positive integers. An area where the sub-pixels 20 are located is an active area (AA). A non-display area, for example, is provided around the AA area. Of course, the non-display area may also be located only at one side or opposite sides of the AA area.

In some embodiments of the present disclosure, as shown in FIG. 1B, the sub-pixels 20 arranged in a row along a horizontal direction X are called the same row of sub-pixels, and the sub-pixels 20 arranged in a column along a vertical direction Y are called a same column of sub-pixels.

Figure 2:
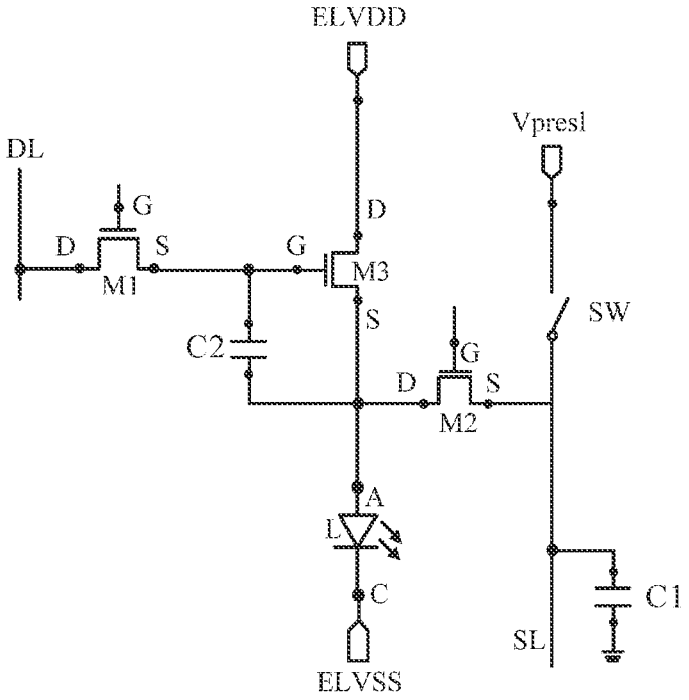
FIG. 2 is a schematic diagram showing a pixel circuit in a sub-pixel shown in FIG. 1B.

As shown in FIG. 2, each sub-pixel 20 includes a light-emitting device L. In some examples, the light-emitting device L is an OLED. In this case, the display panel 10 is an OLED display panel. In other examples, the light-emitting device L is a mirco light-emitting diode (mirco LED). In this case, the display panel 10 is a mirco LED display panel.

In addition, the sub-pixel 20 further includes a pixel driving circuit for driving the light-emitting device L to emit light. As shown in FIG. 2, the pixel driving circuit includes a writing transistor M1, a storage capacitor C2, and a driving transistor M3.

The driving transistor M3 is configured to provide a driving current to the light-emitting device L, to drive the light-emitting device L to emit light. Generally, an aspect ratio of a channel of the driving transistor M3 is greater than those of channels of other transistors.

A gate G of the driving transistor M3 is electrically connected to a second electrode of the writing transistor M1. The second electrode of the writing transistor M1 is, for example, a source S. A first electrode of the driving transistor M3, such as a drain D, is electrically connected to a first power supply voltage terminal ELVDD. A second electrode of the driving transistor M3, such as a source S, is electrically connected to an anode A of the light-emitting device L. A cathode C of the light-emitting device L is electrically connected to a second power supply voltage terminal ELVSS. The first power supply voltage terminal ELVDD is configured to receive a first voltage, and the second power supply voltage terminal ELVSS is configured to receive a second voltage. The first voltage is a high-level signal, and the second voltage is a low-level signal.

An end of the storage capacitor C2 is electrically connected to the gate G of the driving transistor M3, and another end of the storage capacitor C2 is electrically connected to the source S of the driving transistor M3. A first electrode (for example, a drain D) of the writing transistor M1 is electrically connected to a data signal line DL. The data signal line DL is configured to input a data voltage $V_{data}$ to the first electrode of the writing transistor M1 that is connected thereto, to transmit the data voltage $V_{data}$ to the gate G of the driving transistor M3 connected to the writing transistor M1, through the writing transistor M1 in an on state.

In this case, in an image frame, when the sub-pixel 20 is displaying, the writing transistor M1 is turned on, and the data voltage $V_{data}$ is transmitted to the gate G of the driving transistor M3 through the writing transistor M1. After the data voltage $V_{data}$ is transmitted to the gate G of the driving transistor MS to turn on the driving transistor M3, and a current path is formed between the first power supply voltage terminal ELVDD and the second power supply voltage terminal ELVSS. Therefore, a current generated by the driving transistor M3 can flow through the light-emitting device L, which can drive the light-emitting device L to emit light.

The current is $$I_{sd} = \frac{1}{2} \times \mu \times C_{ox} \times \frac{W}{L}(V_{gs} - V_{th})^2.$$

Here, μ is a carrier mobility in the channel of the driving transistor M3; $C_{ox}$ is a capacitance between the gate G and the channel of the driving transistor M3; W/L is the aspect ratio of the channel of the driving transistor M3, and $V_{th}$ is a threshold voltage of the driving transistor M3. Since an emission luminance of the light-emitting device L is determined by a magnitude of the current flowing through the light-emitting device L, it can be known from the above formula that the emission luminance of the light-emitting device L is related to $V_{th}$ of the driving transistor M3.

Due to a difference in process, temperature, device aging and other factors, the $V_{th}$ of each driving transistor M3 in the display panel 10 varies, which may cause the driving currents provided by some driving transistors M3 to respective connected light-emitting devices L to deviate from a target current, thereby resulting in an inconsistent emission luminance of the display panel 10. Therefore, it is necessary to compensate the threshold voltage $V_{th}$ of the driving transistor M3 and to eliminate an impact of the threshold voltage $V_{th}$ on the emission luminance of the display panel 10. On this basis, a voltage of the second electrode (such as the source S in FIG. 2) of each driving transistor M3 can be detected during a blanking time between two adjacent image frames. The $V_{th}$ of the driving transistor M3 is obtained by comparing a voltage of the gate G of the driving transistor M3 and the voltage of the second electrode of the driving transistor M3. Therefore, the $V_{th}$ is compensated by adjusting a magnitude of the data voltage $V_{data}$ according to the comparison results in displaying a next image frame.

In order to realize the detection process, as shown in FIG. 2, the pixel driving circuit of the sub-pixel 20 further includes a sensing transistor M2, a sensing signal line SL, a sensing capacitor C1, and a reset switch SW.

A first electrode of the sensing transistor M2, such as a drain D, is electrically connected to the second electrode (such as the source S) of the driving transistor M3. A second electrode of the sensing transistor M2, such as a source S, is electrically connected to the sensing signal line SL.

In addition, an end of the sensing capacitor C1 is electrically connected to the sensing signal line SL, and the other end of the sensing capacitor C1 is grounded. An end of the reset switch SW is electrically connected to the sensing signal line SL, and another end of the reset switch SW is electrically connected to a reset voltage terminal Vpresl. The reset voltage terminal Vpresl is configured to output a reset voltage.

Figure 3:
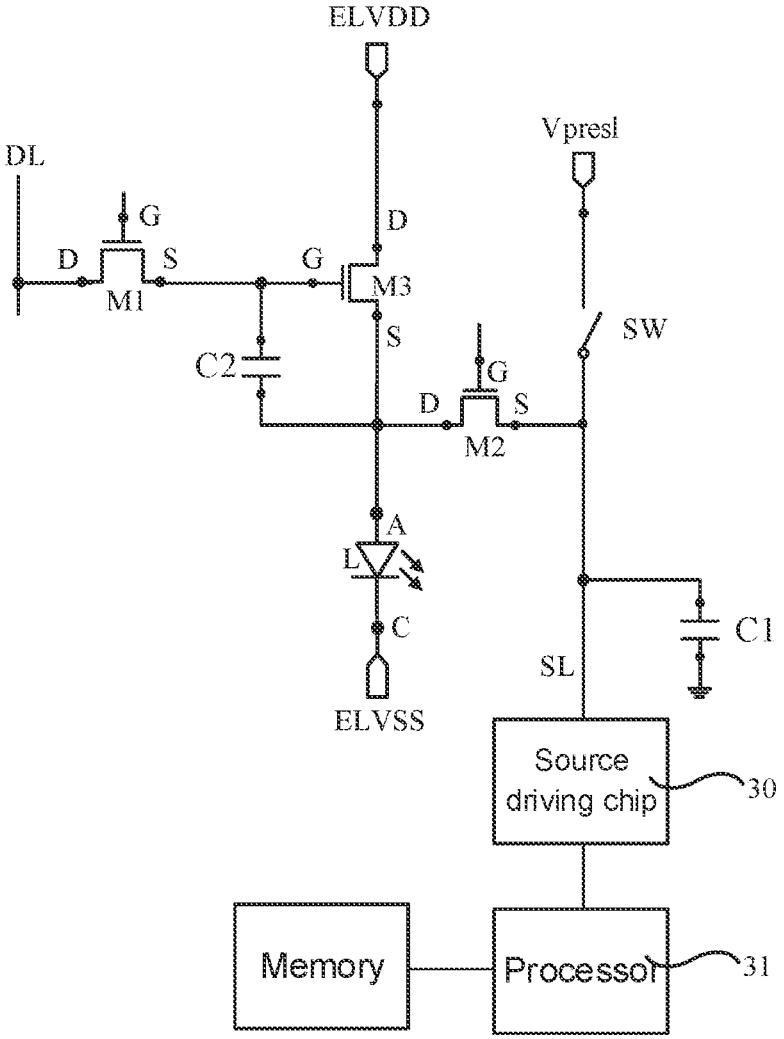
FIG. 3 is a schematic diagram showing electrical connections among the pixel circuit shown in FIG. 2, a source driving signal and a processor.

On this basis, as shown in FIG. 3, in some embodiments, the display panel 10 further includes a source driving chip 30. The source driving chip 30 is electrically connected to the sensing signal line SL. In this case, the source driving chip 30 is configured to detect the voltage of the second electrode (such as the source S) of the driving transistor M3 during a blanking time according to a capacitance of the sensing capacitor C1.

Based on a structure shown in FIG. 3, sensing the voltage of the second electrode (such as the source S) of the driving transistor M3 through the sensing signal line SL is as follows.

First, during the blanking time, the writing transistor M1 and the sensing transistor M2 are turned on. The data voltage $V_{data}$ is transmitted to the gate G of the driving transistor M3 through the writing transistor M1.

Figure 4:
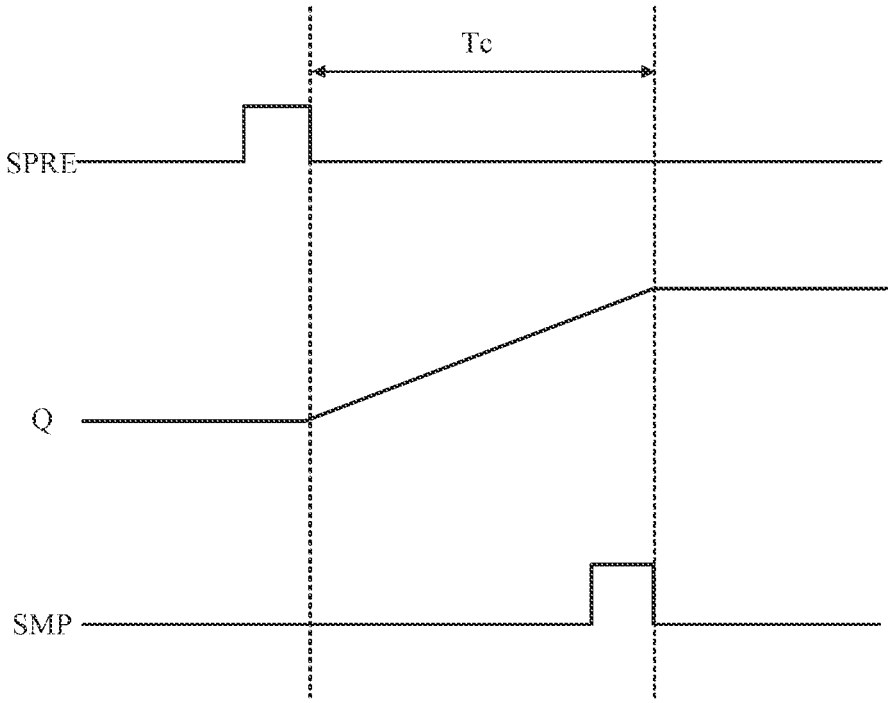
FIG. 4 is a diagram showing a signal timing, according to some embodiments of the present disclosure.

At this time, as shown in FIG. 4, a reset control signal SPRE is input to the reset switch SW which is at a high level, so that the reset switch SW is closed. During a closing period of the reset switch SW, the reset voltage of the reset voltage terminal Vpresl is transmitted to the second electrode (such as the source S) of the driving transistor M3 through the sensing transistor M2.

In some embodiments of the present disclosure, the reset voltage output by the reset voltage terminal Vpresl is 0 V In this case, a voltage of the source S of the driving transistor M3 is 0 V Therefore, the source S of the driving transistor M3 is reset to prevent a residual voltage at the source S of the driving transistor MS from affecting the detecting.

After the reset process is completed, the reset control signal SPIRE is of a low level as shown in FIG. 4, and the reset switch SW is turned off. If a gate-source voltage difference of the driving transistor M3 is $V_{gs}=V_{data}>V_{th}$, the driving transistor M3 is turned on, and the first voltage from the first power supply voltage terminal ELVDD charges the source S of the driving transistor M3, so that the voltage of the source S of the driving transistor M3 increase gradually from a falling edge of the reset control signal SPRE. Meanwhile, as shown in FIG. 4, a charge amount Q of the sensing capacitor C1 that is electrically connected to the sensing signal line SL also increases until $V_{gs}=V_{th}$. In this case, the driving transistor M3 is in a self-saturated state and is turned off, and charging the source S of the driving transistor M3 ends.

In the embodiments of the present disclosure, as shown in FIG. 4, a period from the start of charging to the end of the charging of the source S of the driving transistor M3 can be referred to as a charging time Tc of the sub-pixel 20 having the driving transistor M3.

Next, an analog to digital converter (ADC) in the source driving chip 30 can perform a digital to analog conversion on a voltage charged in the sensing capacitor C1 that is electrically connected to the sensing signal line SL, and can obtain a voltage (that is, a charging voltage of the sub-pixel 20) of the source S of the driving transistor M3 after being charged during the blanking time according to a result of the digital to analog conversion, so as to detect the charging voltage of the sub-pixel 20.

Since the voltage of the source S is $V_s=V_g-V_{th}=V_{data}-V_{th}$ in a case where the driving transistor MS is in the self-saturated state, the $V_{th}$ of the driving transistor M3 can be obtained through the detection process, to compensate the $V_{th}$ in a next image frame.

When the charging of the source S of the driving transistor M3 is to end, a sensing control signal SMP can be provided to a signal control terminal of the source driving chip 30. For example, the electronic apparatus further includes a circuit board (for example, including a printed circuit board and a timing controller provided on the printed circuit board). The circuit board provides the sensing control signal SMP to the source driving chip 30. After the source driving chip 30 detects a falling edge of the sensing control signal SMP it indicates that the charging process has ended. In addition, the electronic apparatus further includes, for example, a gate driving circuit. The gate driving circuit is connected to the circuit board. At an end of the charging process, the gate driving circuit inputs a gate control signal to the writing transistor M1 and the sensing transistor M2 in response to a signal from the circuit board, to turn off the writing transistor M1 and the sensing transistor M2 in FIG. 3.

It should be noted that any one of the writing transistor M1, the sensing transistor M2, and the driving transistor M3 is illustrated as an N-type transistor. In this case, a first electrode of the transistor is a drain D, and a second electrode of the transistor is a source S. Of course, in other embodiments of the present disclosure, any one of the writing transistor M1, the sensing transistor M2, and the driving transistor M3 may be a P-type transistor. In this case, a first electrode of the transistor is a source S, and a second electrode of the transistor is a drain D. For the convenience of description, in the following any one of the writing transistor M1, the sensing transistor M2, and the driving transistor M3 is described as the N-type transistor.

Based on the detection process, in some embodiments of the present disclosure, a method for controlling the charging time of the display panel 10 is provided, to obtain the charging time Tc of each sub-pixel 20 during the detection process.

Figure 5:
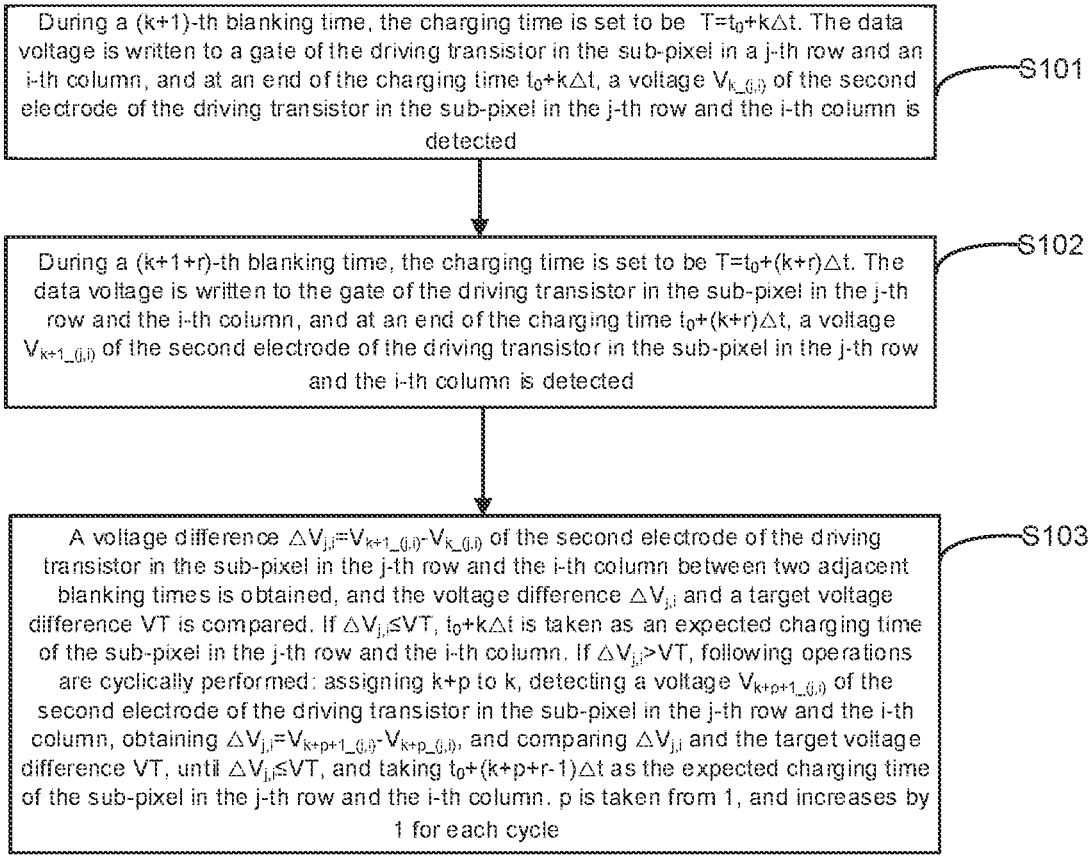
FIG. 5 is a flowchart of a method for controlling a charging time of a display panel, according to some embodiments of the present disclosure.

As shown in FIG. 5, the method for controlling the charging time T of the display panel 10 includes S101 to S103.

In S101, during a (k+1)-th blanking time, a charging time is set to be $T=t_0+k\Delta t$. The data voltage $V_{data}$ is written to a gate G of the driving transistor M3 in the sub-pixel 20 in a j-th row and an i-th column. At an end of the charging time $t_0+k\Delta t$, a voltage $V_{k_(j,i)}$ of the second electrode (such as the source S) of the driving transistor M3 in the sub-pixel 20 in the j-th row and the i-th column is detected. Here, to is an initial charging time; $1\leq j\leq M$, $1\leq i\leq N$; $k\geq 0$; j, i and k are integers.

In some embodiments of the present disclosure, the source S of the driving transistor M3 starts to be charged when the driving transistor M3 is turned on and ends a charging when the driving transistor M3 is turned off. A period from a turning-on to a turning-off of the driving transistor is referred to as a saturation charging time of the driving transistor M3. The initial charging time $t_0$ may be less than or proximate to the saturation charging time. For example, the initial charging time $t_0$ may be ⅓ to ⅔ of the saturation charging time.

For example, in a case of k=0, during a first blanking time in a display process of the display panel 10, the charging time of the sub-pixel 20 (for example, the sub-pixel 20 in the j-th row and the i-th column) is set to be $T=t_0+k\Delta t=t_0$.

Figure 6A:
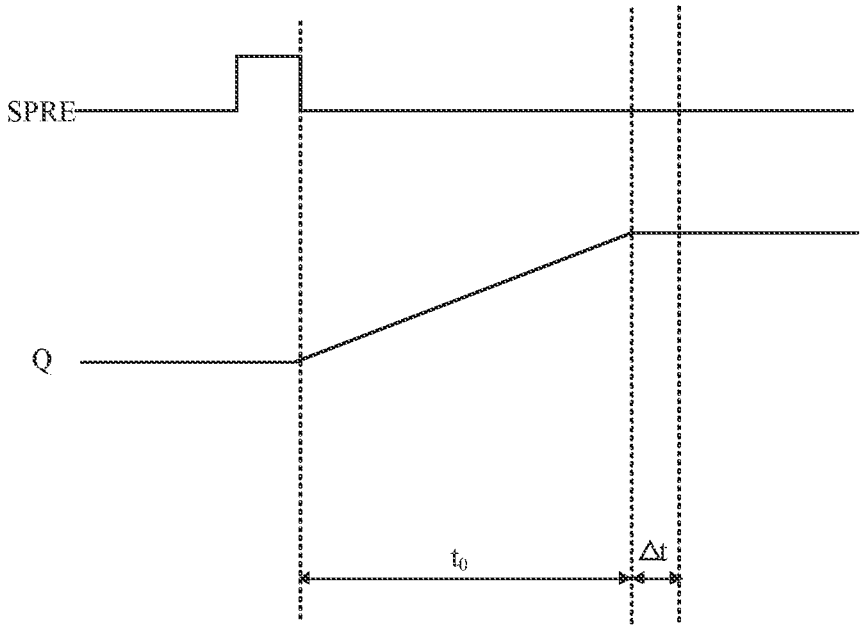
FIG. 6A is a diagram showing another signal timing, according to some embodiments of the present disclosure.
Figure 6B:
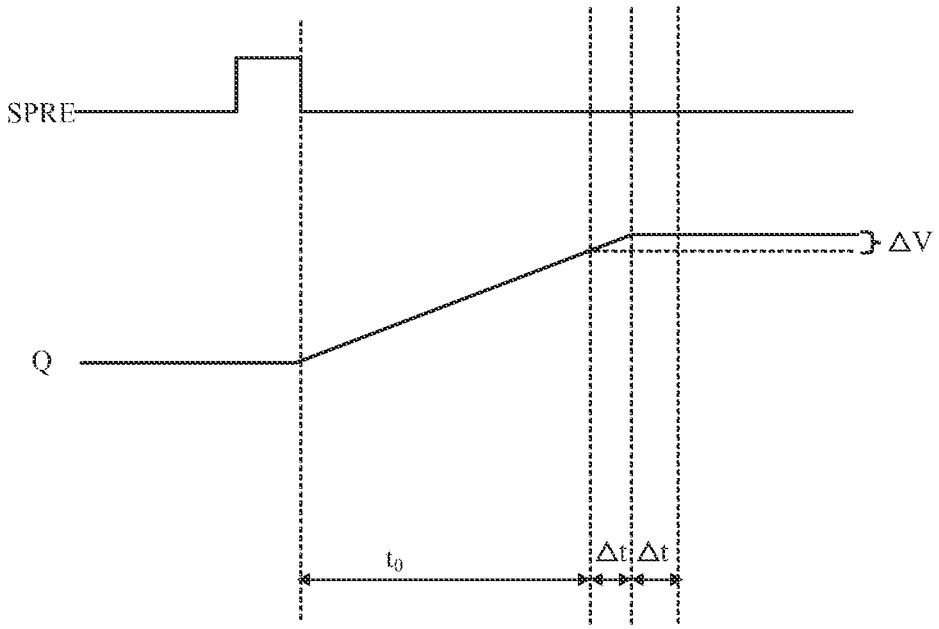
FIG. 6B is a diagram showing yet another signal timing, according to some embodiments of the present disclosure.

The data voltage $V_{data}$ is written to the gate G of the driving transistor M3 in the sub-pixel in the j-th row and the i-th column, and the driving transistor M3 is turned on, so that the first voltage from the first power supply voltage terminal ELVDD charges the source S of the driving transistor M3, A source voltage $V_s$ of the driving transistor M3 gradually increases, as shown in FIGS. 6A and 6B, the charge amount Q of the sensing capacitor C1 also gradually increases.

The sensing control signal SMP as shown in FIG. 4 can be provided to the source driving chip 30. When the source driving chip 30 detects the falling edge of the sensing control signal SMP the charging time to ends. Since the initial charging time to may be less than or proximate to the saturation charging time, the driving transistor M3 may be neither in the self-saturated state nor in a nearly self-saturated state at an end of the set charging time $t_0$.

Next, a voltage $V_{0_(j,i)}$ of the source S of the driving transistor MS is detected through the sensing signal line SL and the source driving chip 30.

It should be noted that in the above, the S101 is exemplarily illustrated taking k=0. When k is taken with other value, the detection process is same as the above, which will not be repeated here.

In S102, during a (k+1+r)-th blanking time, the charging time is set to be $T=t_0+(k+r)\Delta t$. The data voltage $V_{data}$ is written to the gate G of the driving transistor MS in the sub-pixel 20 in the j-th row and the i-th column, and at an end of the charging time $t_0+(k+r)\Delta t$, a voltage $V_{k+1_(j,i)}$ of the second electrode (such as the source S) of the driving transistor M3 in the sub-pixel 20 in the j-th row and the i-th column is detected. Here, $r\geq 1$, and r is a positive integer.

For example, k=0, and r=1. During a second blanking time in the display process of the display panel 10, the charging time of the sub-pixel 20 in the j-th row and the i-th column is set to be $T=t_0+(k+r)\Delta t=t_0+\Delta t$. That is, a time Δt is added to the charging time to in S101.

The data voltage $V_{data}$ is written to the gate G of the driving transistor M3 in the sub-pixel in the j-th row and the i-th column, and the driving transistor M3 is turned on, so that the first voltage from the first power supply voltage terminal ELVDD charges the source S of the driving transistor M3. The voltage $V_s$ of the source of the driving transistor M3 gradually increases, as shown in FIGS. 6A and 6B, the charge amount Q of the sensing capacitor C1 also gradually increases.

The sensing control signal SMP as shown in FIG. 4 can be provided to the source driving chip 30 again. After the source driving chip 30 detects the falling edge of the sensing control signal SMP, the charging time $t_0+\Delta t$ ends.

Next, a voltage $V_{1_(j,i)}$ of the source S of the driving transistor M3 is detected through the sensing signal line SL and the source driving chip 30.

It should be noted that r=1 is exemplarily taken in the above. When r=2, the S102 can be executed during a third blanking time. Wien r=3, the S102 can be executed during a fourth blanking time, and so on, which is not limited in the present disclosure. Therefore, a blanking time during which the S102 is executed may be continuous or not continuous with a blanking time during which S101 is executed, which is not limited in the present disclosure.

In S103, a voltage difference $\Delta V_{j,i}=V_{k+1_(j,i)}-V_{k_(j,i)}$ of the second electrode (such as the source S) of the driving transistor M3 in the sub-pixel 20 in the j-th row and the i-th column between two adjacent blanking times is obtained, and the voltage difference $\Delta V_{j,i}$ is compared with a target voltage difference VT.

It should be noted that, from the above, the blanking time during which S102 is executed may be continuous or not continuous with the blanking time during which S101 is executed. Therefore, the two adjacent blanking times here refer to two blanking times during which the voltages of the second electrode of the driving transistor M3 in a same sub-pixel 20 are detected twice adjacently.

For example, when S101 is executed, the voltage of the source S of the driving transistor M3 in the sub-pixel 20 in the j-th row and the i-th column is detected in the first blanking time. When S102 is executed, the voltage of the source S of the driving transistor M3 in the sub-pixel 20 in the j-th row and the i-th column is detected in the second blanking time. Then, during both the first blanking time and the second blanking time, the voltages of the source S of the driving transistor M3 in the same sub-pixel 20 (that is, the sub-pixel 20 in the j-th row and the i-th column) are detected. Therefore, the first blanking time and the third blanking time are the two adjacent blanking times described in S103.

In addition, if $\Delta V_{j,i}\leq VT$ the $t_0+k\Delta t$ is taken as an expected charging time of the sub-pixel 20 in the j-th row and the i-th column.

For example, when k=0, r=1, $\Delta V_{j,i}=V_{1_(j,i)}-V_{0_(j,i)}\leq VT$, the expected charging time of the sub-pixel 20 in the j-th row and the i-th column is the set charging time to when the S101 is executed.

In some embodiments of the present disclosure, the target voltage difference VT may be set in a range of 0 V to 3 V. For example, the target voltage difference VT may be 0 V, 1 V, 2 V, or 3 V. In some embodiments of the present disclosure, considering an error caused by an IC and other electronic devices in a circuit, the target voltage difference VT may be proximate to 0V.

In related arts, a charging time of each sub-pixel of a display panel is same. However, due to factors such as manufacturing process, threshold voltages and other parameters of driving transistors in pixel circuits of the display panel are different, and a time for each driving transistor to reach the self-saturated state in a charging process is also different. When a same charging time is used, some of the sub-pixels is overcharged or undercharged.

In the method for controlling the charging time in some embodiments of the present disclosure, by adding $\Delta t$ to the originally set and fixed charging time $t_0$, and judging whether the voltage difference of the source S of the driving transistor M3 between the two detecting is less than or equal to the target voltage difference VT, it can be determined whether the two detected voltages of the source S of the driving transistor M3 approach each other. If $\Delta V_{j,i}=V_{1_(j,i}-V_{0_(j,i)}\leq VT$, the two detected voltages of the source S of the driving transistor M3 approach each other. In this case, as shown in FIG. 6A, it means that the charge amounts Q of the sensing capacitor C1 approach each other during the two charging processes, or when the charge amount Q of the sensing capacitor C1 reaches a stable level during the second charging process, and it does not increase further. Therefore, at this time, the set charging time (such as $t_0$) during the previous charging process can be selected as the expected charging time of the sub-pixel 20.

If $\Delta V_{j,i}>VT$, following operations are cyclically executed: assigning k+p to k, detecting a voltage $V_{k+p+1_(j,i)}$ of the second electrode of the driving transistor M3 in the sub-pixel 20 in the j-th row and the i-th column, obtaining $\Delta V_{j,i}=V_{k+p+1_(j,i)}-V_{k+p_(j,i)}$, comparing a magnitude of $\Delta V_{j,i}$ with the target voltage difference VT, until $\Delta V_{j,i}\leq VT$, and taking $t_0+(k+p+r-1)\Delta t$ as the expected charging time of the sub-pixel 20 in the j-th row and the i-th column. p is taken from 1, and increases by 1 for every cycle.

In a case where a comparison in S103 is made to be $\Delta V_{j,i}>VT$, two detected voltages of the source S of the driving transistor M3 are of great difference therebetween, which means that during the two charging processes, the charge amount Q of the sensing capacitor C1, as shown in FIG. 6B, is in a rising phase, the driving transistor M3 has not yet approached or reached the self-saturated state. Therefore, it is necessary to repeat the charging process during a next blanking time in the display, and a charging time of the sub-pixel 20 in the j-th row and the i-th column can be increased by the time $\Delta t$ from a previous charging time for each repetition.

For example, k is taken as 0, and p=1 when the charging process is executed in a first cycle, and k+p is assigned to k. At this time, in a case of r=1, during the third blanking time in the display process of the display panel 10, a charging time of the sub-pixel 20 in the j-th row and the i-th column is set to be $T=t_0+(k+p+r)\Delta t=t_0+2\Delta t=t_0+\Delta t+\Delta t$.

Similarly, during the set charging time $t_0+2\Delta t$, the source S of the driving transistor M3 is charged by the first voltage from the first power supply voltage terminal ELVDD. When the source driving chip 30 detects the falling edge of the sensing control signal SMP, the charging time $t_0+2\Delta t$ ends, and a voltage $V_{2_(j,i)}$ of the source S of the driving transistor M3 is detected.

Next, $\Delta V_{j,i}=V_{2_(j,i)}-V_{1_(j,i)}$, is obtained, and it is judged that whether $\Delta V_{j,i}$ is less than or equal to the target voltage difference VT If $\Delta V_{j,i}$ is less than or equal to the target voltage difference VT, then, it can be determined that the expected charging time of the sub-pixel 20 in the j-th row and the i-th column is $T=t_0+(k+p+r-1)\Delta t=t_0+\Delta t$.

If $\Delta V_{j,i}=V_{2_(j,i)}-V_{1_(j,i)}>VT$, the above are repeated, and p increases by 1 (that is, p=2). During a fourth blanking time in the display process of the display panel 10, a charging time of the sub-pixel 20 in the j-th row and the i-th column is set to be $T=t_0+(k+p+r)\Delta t=t_0+3\Delta t$, and the source S of the driving transistor M3 in the sub-pixel 20 in the j-th row and the i-th column is charged. At an end of the charging time $t_0+3\Delta t$, a voltage $V_{3_(j,i)}$ of the source S of the driving transistor M3 is detected. $\Delta V_{j,i}=V_{3_(j,i)}-V_{2_(j,i)}$ is obtained, and it is judged that whether $\Delta V_{j,i}$ is less than or equal to the target voltage difference VT If $\Delta V_{j,i}$ is less than or equal to the target voltage difference VT then, it can be determined that the expected charging time of the sub-pixel 20 in the j-th row and the i-th column is $T=t_0+(k+p+r-1)\Delta t=t_0+2\Delta t$. If $\Delta V_{j,i}=V_{3_(j,i)}-V_{2_(j,i)}>VT$, the above are repeated again so that the charging time of the sub-pixel 20 in the j-th row and the i-th column continues to increase by $\Delta t$, until $\Delta V_{j,i}\leq VT$. At this time, the expected charging time of the sub-pixel 20 in the j-th row and the i-th column is $t_0+(k+p+r-1)\Delta t$.

In summary, the charging time of the source S of the driving transistor M3 in a sub-pixel 20 can be gradually increased during a plurality of blanking times through the method for controlling the charging time of the display panel 10, so that the voltage of the source S of the driving transistor M3 gradually increases, so as to gradually reach the self-saturated state. In this process, by gradually increasing the charging time, the respective charging time when the driving transistor M3 is proximate to or reaching the self-saturated state can be obtained, so that the expected charging time of the driving transistor M3 can be obtained more accurately.

In addition, the expected charging time of a single sub-pixel 20 can be obtained through the above method. Furthermore, it is capable of avoiding a problem of overcharging or undercharging due to a same charging time for all of the sub-pixels 20.

It should be noted that S101, S102, and S103 described above are merely used as step numbers, but do not limit a sequence of the steps.

Figure 7:
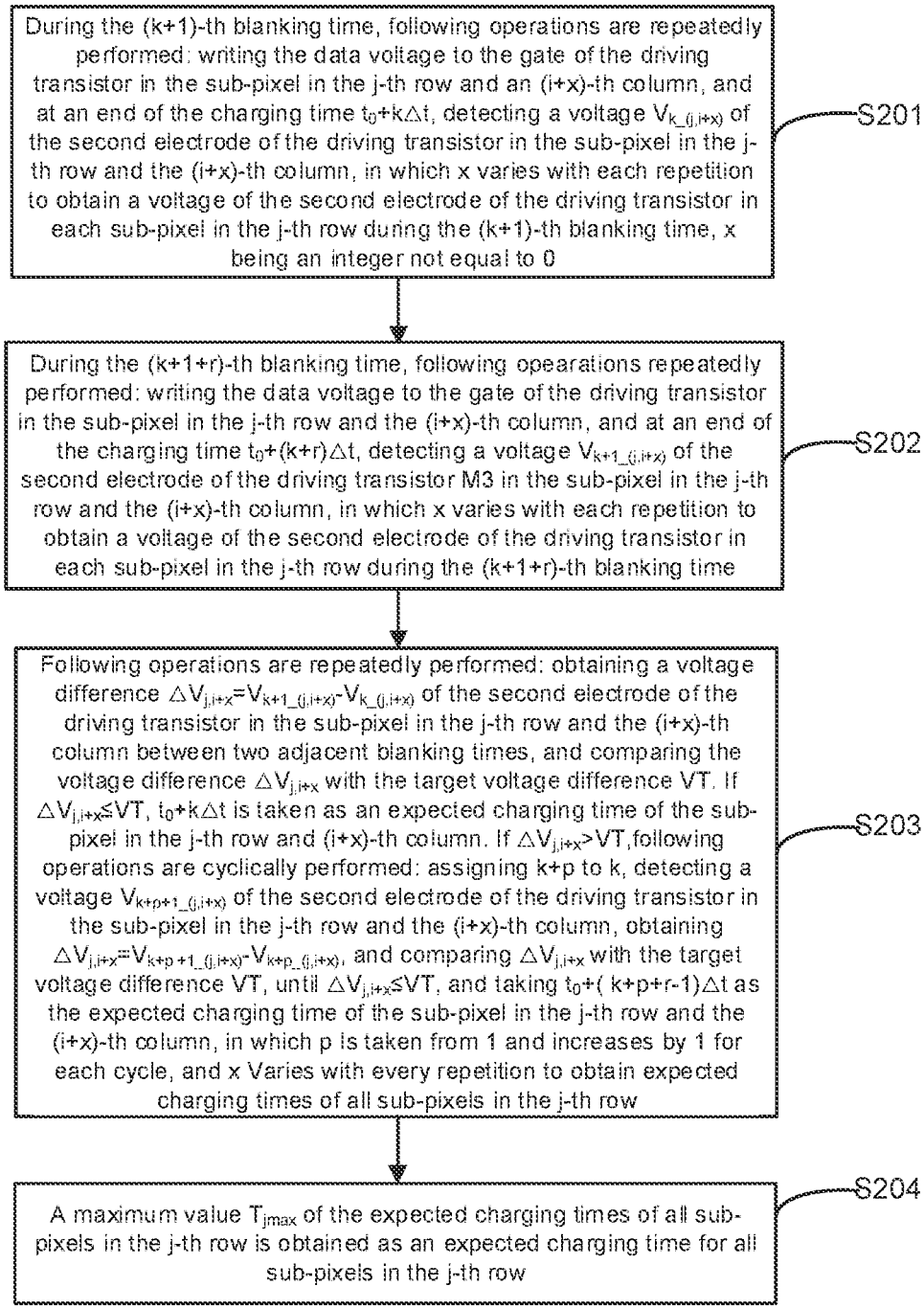
FIG. 7 is a flowchart of another method for controlling a charging time of a display panel, according to some embodiments of the present disclosure.

On this basis, as shown in FIG. 7, the method for controlling the charging time of the display panel in some embodiments of the present disclosure further includes S201 to S204.

In S201, during the (k+1)-th blanking time, following operations are repeatedly executed: writing the data voltage $V_{data}$ to the gate G of the driving transistor M3 in the sub-pixel in the j-th row and an (i+x)-th column, and at an end of the charging time $t_0+k\Delta t$, detecting a+ voltage $V_{k_(j,i+x)}$ of the second electrode of the driving transistor M3 in the sub-pixel in the j-th row and the (i+x)-th column. x varies with each repetition to obtain voltages of the second electrodes (such as the sources S) of the driving transistors M3 in each sub-pixel in the j-th row during the (k+1)-th blanking time. x is an integer not equal to 0.

For example, when k=0, during the first blanking time, i+x is assigned to i, and S101 is executed repeatedly, and x varies with each repetition. In this way, on a basis of S101 described above, voltages ($V_{0_(j,1)}$, $V_{0_(j,2)}$, $V_{0_(j,3)}$ . . . $V_{0_(j,N)}$) of the sources S of the driving transistors M3 in all sub-pixels in the j-th row can be obtained during the first blanking time.

In S202, during the (k+1+r)-th blanking time, following operations are repeatedly executed: writing the data voltage $V_{data}$ to the gate of the driving transistor M3 in the sub-pixel 20 in the j-th row and the (i+x)-th column, and at an end of the charging time $t_0+(k+r)\Delta t$, detecting a voltage $V_{k+1_(j,i+x)}$ of the second electrode of the driving transistor M3 in the sub-pixel in the j-th row and the (i+x)-th column. x varies with each repetition to obtain voltages of the second electrodes of the driving transistors in each sub-pixel in the j-th row during the (k+1+r)-th blanking time.

For example, k=0, r=1, during the second blanking time, i+x is assigned to i, and S102 is executed repeatedly, and x varies with each repetition. In this way, on a basis of S102 described above, voltages ($V_{1_(j,1)}$, $V_{1_(j,2)}$, $V_{1_(j,3)}$ . . . $V_{1_(j,N)}$) of the sources S of the driving transistors M3 in all sub-pixels 20 in the j-th row can be obtained during the second blanking time.

In S203, following operations are repeatedly executed: obtaining a voltage difference $\Delta V_{j,i+x}=V_{k+1_(j,i+x)}-V_{k_(j,i+x)}$ of the second electrode of the driving transistor in the sub-pixel 20 in the j-th row and the (i+x)-th column between two adjacent blanking times, comparing the voltage difference $\Delta V_{j,i+x}$ with the target voltage difference VT, if $\Delta V_{j,i+x}\leq VT$, taking $t_0+k\Delta t$ as an expected charging time of the sub-pixel 20 in the j-th row and (i+x)-th column, if $\Delta V_{j,i+x}>VT$, cyclically performing: assigning k+p to k, detecting a voltage $V_{k+p+1_(j,i+x)}$ of the second electrode of the driving transistor M3 in the sub-pixel in the j-th row and the (i+x)-th column, obtaining $\Delta V_{j,i+x}=V_{k+p+1_(j,i+x)}-V_{k+p_(j,i+x)}$, and comparing $\Delta V_{j,i+x}$ with the target voltage difference VT, until $\Delta V_{j,i+x}\leq VT$, and taking $t_0+(k+p+r-1)\Delta t$ as the expected charging time of the sub-pixel in the j-th row and the (i+x)-th column. p is taken from 1, and increases by 1 for each cycle. x varies with each repetition to obtain expected charging times of all sub-pixels 20 in the j-th row.

For example, the voltage difference of the source S of a same driving transistor M3 (for example, a driving transistor M3 in a same sub-pixel 20) during two adjacent blanking times (for example, the second blanking time and the first blanking time) is compared with the target voltage difference VT in a same way as described above. Similarly, the expected charging times ($T_{j1}$, $T_{j2}$, $T_{j3}$ . . . $T_{jN}$) of all sub-pixels 20 in the j-th row can be finally determined.

Each comparing and the determining of the expected charging time of a single sub-pixel 20 are same as those described above, which will not be repeated here.

In S204, a maximum value $T_{jmax}$ of the expected charging times of all sub-pixels in the j-th row is obtained as an expected charging time (that is, an actual charging time) for all sub-pixels in the j-th row.

That is, the expected charging time for the sub-pixels 20 in the j-th row is $T_j=T_{jmax}=\max(T_{j1}, T_{j2}, T_{j3} \ldots T_{jN})$. In this way, by taking the maximum value $T_{jmax}$ of the expected charging times of all sub-pixels 20 in the j-th row as the expected charging time (that is, the actual charging time) $T_j$ for all sub-pixels 20 in the j-th row, the expected charging time for all sub-pixels 20 in the j-th row is a minimum reasonable charging time.

With the minimum reasonable charging time, it can be ensured that each of the sub-pixels 20 in a row will not be undercharged. In addition, overcharges of all sub-pixels 20 in the j-th row, due to the expected charging time of the sub-pixels 20 in the j-th row being greater than the $T_{jmax}$, can also be avoided.

In addition, when one charging time (for example, the expected charging time $T_j$) is used for each sub-pixel 20 located in a same row, it is capable of avoiding using a single charging time for each sub-pixel 20, which results in a complicated charging control process.

It should be noted that S201, S202, S203, and 8204 described above are merely used as step numbers, but do not limit a sequence of the steps.

Figure 8A:
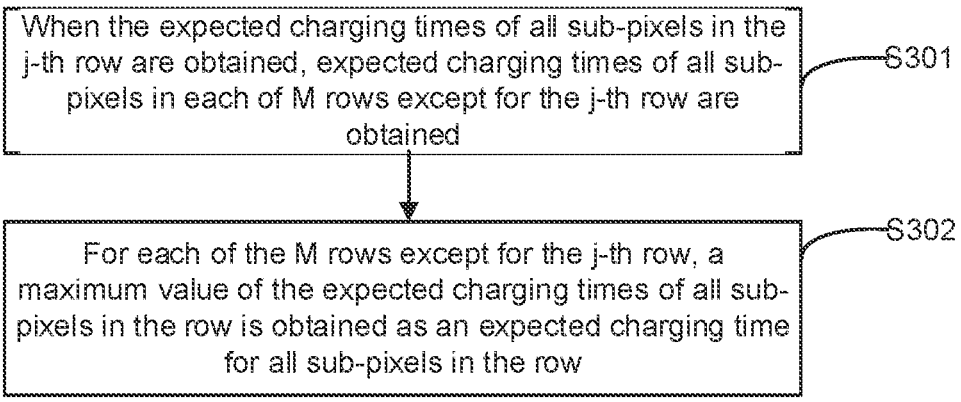
FIG. 8A is a flowchart of yet another method for controlling a charging time of a display panel, according to some embodiments of the present disclosure.

On this basis, in order to obtain the expected charging time for the sub-pixels 20 in each row, in some embodiments of the present disclosure, the voltages of the sources S of the driving transistors M3 in the sub-pixels 20 in each row can also be detected row by row. In order to achieve a detection row by row, in some embodiments, as shown in FIG. 8A, the method for controlling the charging time of the display panel further includes S301 to S302.

In S301, when the expected charging times of all sub-pixels in the j-th row are obtained, expected charging times of all sub-pixels 20 in each of the M rows except for the j-th row are obtained.

For example, the method for controlling the charging time of the display panel further includes, when S201 is executed to obtain the voltage of the second electrode (such as the source S) of the driving transistor M3 in each sub-pixel 20 in the j-th row during the (k+1)-th blanking time: assigning j+y to j, and repeatedly executing S201. y varies with each repetition to obtain the voltages of the second electrodes (such as the sources S) of the driving transistors M3 in all sub-pixels 20 in each of the M rows except for the j-th row during the (k+)-th blanking time. Here, y is an integer not equal to 0.

The method for controlling the charging time of the display panel further includes, when S202 is executed to obtain the voltage of the second electrode (such as the source S) of the driving transistor M3 in each sub-pixel 20 in the j-th row during the (k+1+r)-th blanking time: assigning j+y to j, and repeatedly executing S202. y varies with each repetition to obtain the voltages of the second electrodes (such as the sources S) of the driving transistors M3 in all sub-pixels 20 in each of the M rows except for the j-th row during the (k+1+r)-th blanking time.

The method for controlling the charging time of the display panel further includes, when S203 is executed to obtain the expected charging times of all sub-pixel 20 in the j-th row: assigning j+y to j, and repeatedly executing 8203. y varies with each repetition to obtain expected charging times of all sub-pixels 20 in each of the M rows except for the j-th row.

In S302, for each of the M rows except the j-th row, a maximum value of the expected charging times of all sub-pixels 20 in the row is obtained as an expected charging time (that is, an actual charging time) for all sub-pixels 20 in the row.

For example, the method for controlling the charging time of the display panel further includes, when S204 is executed: assigning j+y to j, and repeatedly executing S204. y varies with each repetition to obtain the expected charging time for all sub-pixels 20 in each row of the M rows except the j-th row.

It should be noted that S301 and S302 described above are merely used as step numbers, but do not limit a sequence of the steps.

Figure 8B:
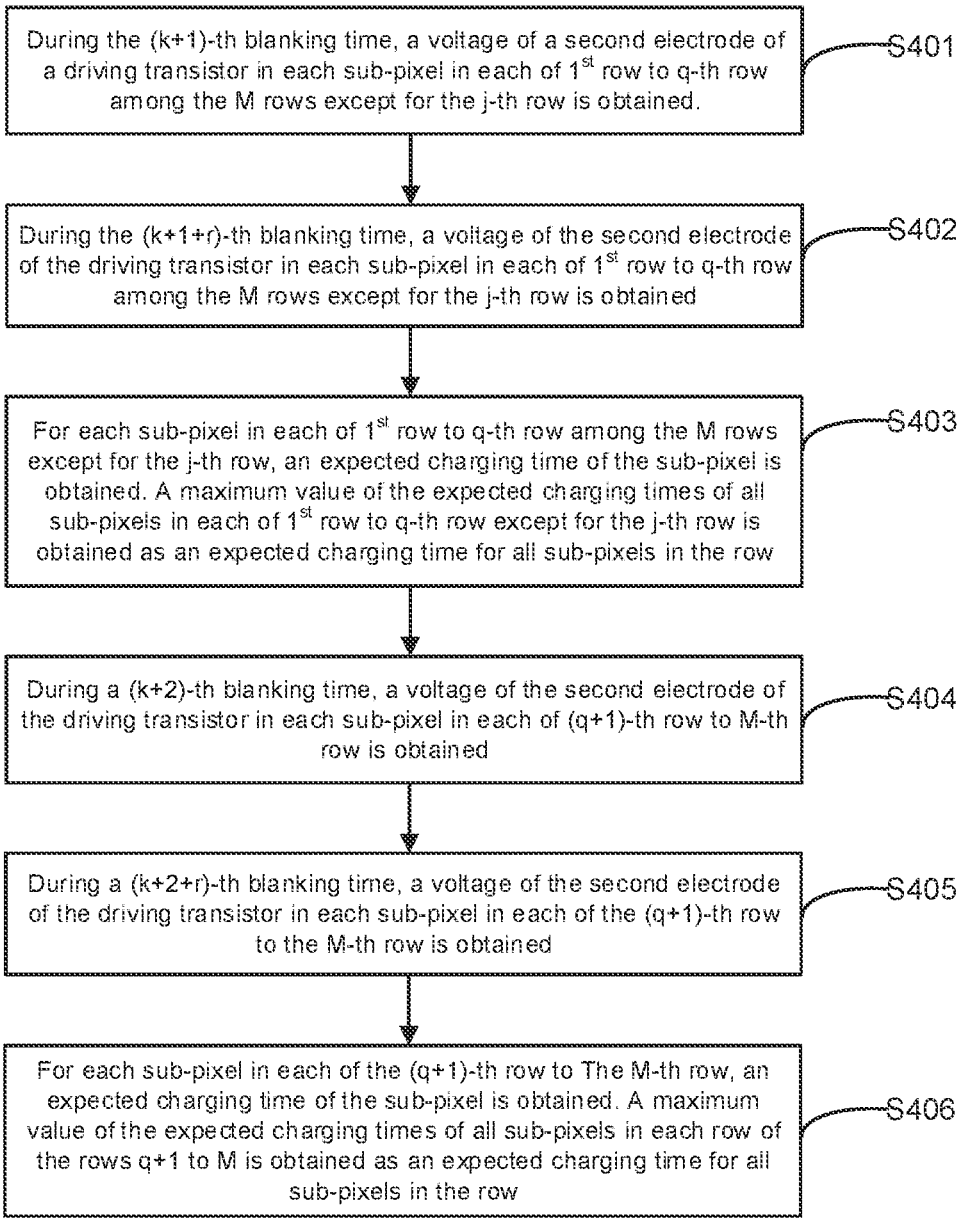
FIG. 8B is a flowchart of yet another method for controlling a charging time of a display panel, according to some embodiments of the present disclosure.

AOr, in other embodiments, in order to achieve the detection row by row, as shown in FIG. 8B, the method for controlling the charging time of the display panel further includes S401 to S406.

In S401, during the (k+1)-th blanking time, the voltage of the second electrode (such as the source S) of the driving transistor M3 in each sub-pixel 20 in each of the 1 st row to the q-th row among the M rows except for the j-th row is obtained. Here, $j\leq q<M$, and $q\geq 0$, and q is a positive integer.

For example, k=0, q=3, and an initial value of j is 1. The above steps can be executed in such a way that during the first blanking time, j+z is assigned to j(z is taken from 1), and S201 is executed repeatedly. z increases by 1 for each repetition. After S201 described above is executed twice, the voltage of the source S of the driving transistor M3 in each sub-pixel 20 in each of two adjacent rows (for example, a second row and a third row) can be obtained during the first blanking time.

Therefore, q is a number of rows of the sub-pixels 20 in which the voltages of the sources S of the driving transistor M3 can be detected row by row during the first blanking time.

Figure 9:
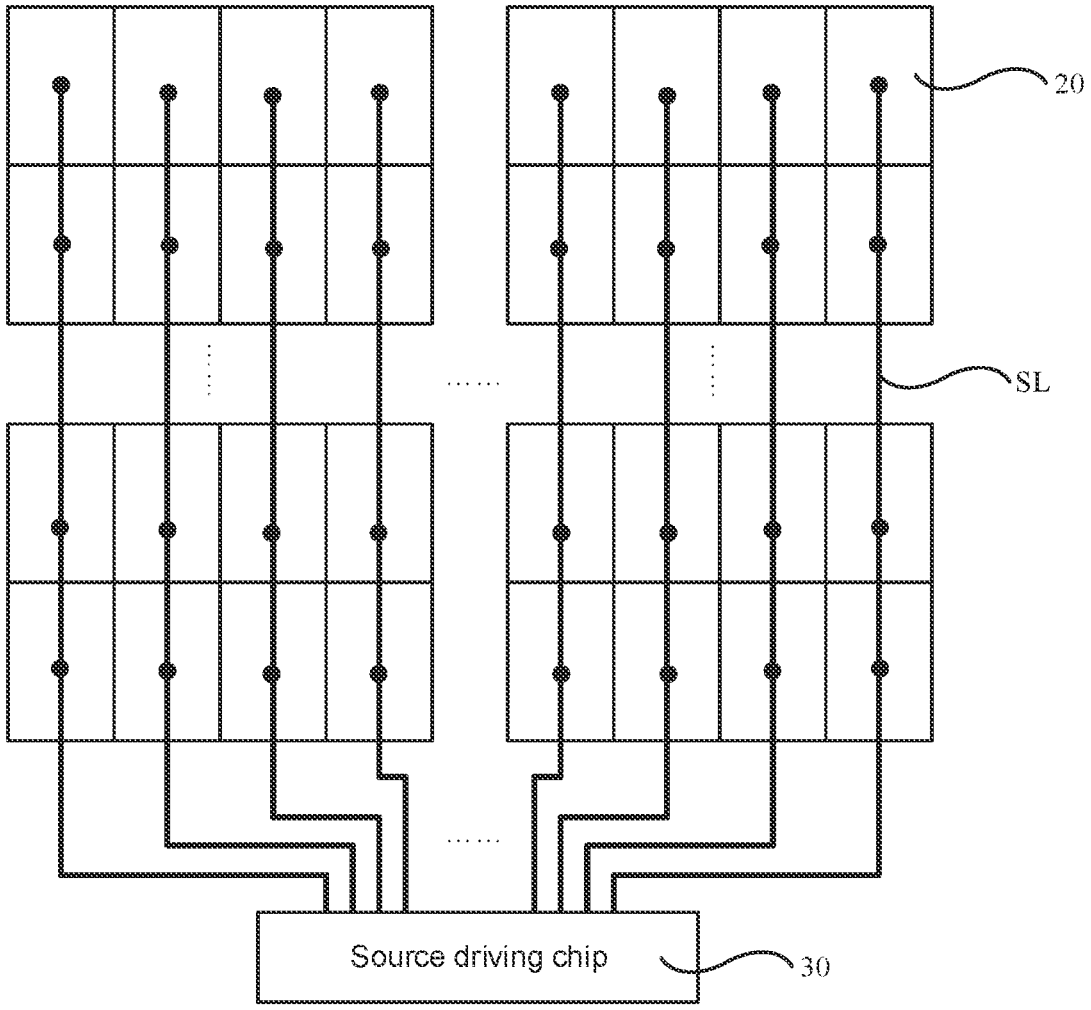
FIG. 9 is a schematic diagram showing a structure of a display panel, according to some embodiments of the present disclosure.

In detecting row by row, the voltage of the source S of the driving transistor M3 in each sub-pixel 20 in each column can be transmitted to the source driving chip 30 through a sensing signal line SL as shown in FIG. 9. In this case, the sub-pixels 20 in the same column can be connected to a same sensing signal line SL.

In 8402, during the (k+1+r)-th blanking time, the voltage of the second electrode (such as the source S) of the driving transistor M3 in each sub-pixel 20 in each of the 1st row to the q-th row among the the M rows except for the j-th row is obtained.

For example, the initial value of j is 1. During the (k+1+r)-th blanking time, j+z is assigned to j (z is taken from 1), and S202 is executed repeatedly. And z increases by 1 for each repetition to obtain the voltage of the second electrode (such as the source S) of the driving transistor M3 in each sub-pixel 20 in each of 2nd row to q-th row among the M rows.

In S403, an expected charging time of the sub-pixel 20 is obtained for each sub-pixel 20 in each of the 1st row to the q-th row among the M rows except for the j-th row. A maximum value of the expected charging times of all sub-pixels 20 in each of theist row to the q-th row except for the j-th row is obtained as an expected charging time (that is, an actual charging time) for all sub-pixels 20 in the row.

For example, for each sub-pixel 20 in each of 1st row to q-th row of the M rows except for the j-th row, 1 to q except for j are respectively assigned to j, and S203 is executed respectively to obtain the expected charging times of all sub-pixels 20 in each of the 1st row to the q-th row among the M rows except for the j-th row. Then, a maximum value of the expected charging times of all sub-pixels 20 in each of the 1st row to the q-th row except for the j-th row is obtained as the expected charging time for all sub-pixels 20 in the row.

In S404, during a (k+2)-th blanking time, a voltage of the second electrode (such as the source S) of the driving transistor M3 in each sub-pixel 20 in each of (q+1)-th row to M-th row is obtained.

For example, when k=0, q=3, during the second blanking time, q+h is assigned to j (h is taken from 1), and S201 is executed repeatedly. h increases by 1 for each repetition, so that on a basis of S401, the voltage of the source S of the driving transistor M3 in each sub-pixel 20 in each row after the third row of sub-pixels 20 during the second blanking time can be obtained. In this way, when the detection of the voltages of the sources S of the driving transistors M3 in the sub-pixels 20 in all rows is not completed during a current blanking time, the sub-pixels that have not been detected can be detected row by row during a next blanking time, so as to ensure that the voltages of the sources S of the driving transistors M3 in the sub-pixels 20 in all rows can be detected.

In S405, during a (k+2+r)-th blanking time, the voltage of the second electrode of the driving transistor M3 in each sub-pixel 20 in each of the (q+1)-th row to the M-th row is obtained.

For example, during the (k+2+r)-th blanking time, q+h is assigned to j (h is taken from 1), and S202 is executed repeatedly. And h increases by 1 for each repetition to obtain the voltage of the second electrode (such as the source S) of the driving transistor M3 in each sub-pixel 20 in each of the (q+1)-th row to the M-th row.

In S406, for each sub-pixel 20 in each of the (q+1)-th row to the M-th row, an expected charging time of the sub-pixel 20 is obtained. A maximum value of the expected charging times of all sub-pixels 20 in each of the the (q+1)-th row to the M-th row is obtained as an expected charging time (that is, an actual charging time) for all sub-pixels 20 in the row.

For example, for each sub-pixel 20 in each of the (q+1)-th row to the M-th row, q+1 to M are respectively assigned to j, and S203 is executed respectively to obtain the expected charging time of each sub-pixel 20 in each of the (q+1)-th row to the M-th row. Then, the maximum value of the expected charging times of all sub-pixels 20 in each of the (q+1)-th row to the M-th row is obtained as the expected charging time for all sub-pixels 20 in the row.

It should be noted that S401, S402, S403, S404, S405, and S406 described above are merely used as step numbers, but do not limit a sequence of the steps.

On this basis, the expected charging time ($T_1$, $T_2$, $T_3$ . . . $T_M$) for the sub-pixels 20 in each rows can be obtained through the above method. Next, the expected charging time ($T_1$, $T_2$, $T_3$ . . . $T_M$) for the sub-pixels 20 in each row are stored.

In this case, during a blanking time in the subsequent display process, the expected charging time $T_j=T_{jmax}$ for the sub-pixels 20 in any row (for example, in the j-th row) can be directly read, and at a start of $T_1$, the data voltage $V_{data}$ is input to the gate G of the driving transistor M3 in each sub-pixel 20 in the j-th row. It can be seen from the above that the driving transistor MS is turned on at this time, and the first voltage from the first power supply voltage terminal ELVDD charges the source S of the driving transistor M3. In this way, an overcharge or undercharge phenomenon of the sub-pixels 20 in the row can be eliminated.

It should be noted that obtaining the expected charging time ($T_1$, $T_2$, $T_3$ . . . $T_M$) for the sub-pixels 20 in each rows may be performed before the electronic apparatus 01 is shipped, or may be performed during user's use after the electronic apparatus 01 is sold, which is not limited in the embodiments of the present disclosure.

In some embodiments, in order to improve accuracy of the detection results, the method further includes: writing the reset voltage provided by the reset voltage terminal Vpresl to the second electrode (such as the source S) of the driving transistor M3 during each blanking time for detecting the voltage of the second electrode of the driving transistor M3 and before the charging time T. Therefore, it can prevent the residual voltage at the source S of the driving transistor M3 from affecting the detecting.

In this case, as shown in FIG. 6A or FIG. 6B, when the reset control signal SPRE of a low level is input, the reset process ends. At this time, the source S of the driving transistor M3 in a sub-pixel 20 can be charged.

In some embodiments of the present disclosure, a non-transitory computer readable medium having computer program stored therein is provided. Any one of the methods as described above is implemented when the computer program is executed.

In addition, the electronic apparatus 01 in the embodiments of the present disclosure further includes a memory and a processor 31 as shown in FIG. 3. The processor 31 is electrically connected to the source driving chip 30. The memory is configured to store one or more programs. The processor 31 is configured to execute the one or more programs. When the one or more programs are executed by the processor 31, any one of the methods as described above is implemented.

In some embodiments of the present disclosure, the processor 31 may be a field programmable gate array (FPGA) chip. Or in other embodiments of the present disclosure, the processor 31 may be a central processing unit (CPU).

Those of ordinary skill in the art can understand that the memory includes various medium that can store program codes, such a ROM, a RAM, a magnetic disk, or an optical disk.

The forgoing descriptions are merely specific implementations of the present disclosure, but the protection scope of the present disclosure is not limited thereto. Any changes or replacements those skilled in the art could conceive of within the technical scope of the present disclosure shall be included in the protection scope of the present disclosure. Therefore, the protection scope of the present disclosure shall be subject to the protection scope of the claims.

What is claimed is:

1. A method for controlling a charging time of a display panel, wherein the display panel includes sub-pixels in M rows and N columns, and each sub-pixel includes a light-emitting device and a driving transistor; a second electrode of the driving transistor is electrically connected to an anode of the light-emitting device; wherein $M \geq 1$, $N \geq 1$, and M and N are positive integers;

the method comprises:

during a (k+1)-th blanking time, setting a charging time of a sub-pixel in a j-th row and an i-th column to be $T=t_0+k\Delta t$, writing a data voltage to a gate of a driving transistor in the sub-pixel in the j-th row and the i-th column and at an end of the charging time $t_0+k\Delta t$, detecting a voltage $V_{k_(j,i)}$ of a second electrode of the driving transistor, wherein $t_0$ is an initial charging time, and $t_0$ is less than a saturation charging time of the driving transistor, and $1 \leq j \leq M$, $1 \leq i \leq N$, $k \geq 0$, i, j and k are integers;

during a (k+1+r)-th blanking time, setting the charging time of the sub-pixel in the j-th row and the i-th column to be $T=t_0+(k+r)\Delta t$, writing the data voltage to the gate of the driving transistor in the sub-pixel in the j-th row and the i-th column and at an end of the charging time $t_0+(k+r)\Delta t$, detecting a voltage $V_{k+1_(j,i)}$ of the second electrode of the driving transistor, $r \geq 1$, and r being a positive integer;

obtaining a voltage difference $\Delta V_{j,i}=V_{k+1_(j,i)}-V_{k_(j,i)}$ of the second electrode of the driving transistor in the sub-pixel in the j-th row and the i-th column between two adjacent blanking times, comparing the voltage difference $\Delta V_{j,i}$ with a target voltage difference VT;

if $\Delta V_{j,i} \leq VT$, taking $t_0+k\Delta t$ as an expected charging time of the sub-pixel in the j-th row and the i-th column; and if $\Delta V_{j,i} > VT$, cyclically performing: assigning k+p to k, detecting a voltage $V_{k+p+1_(j,i)}$ of the second electrode of the driving transistor in the sub-pixel in the j-th row and the i-th column, obtaining $\Delta V_{j,i}=V_{k+p+1_(j,i)}-V_{k+p_(j,i)}$, comparing $\Delta V_{j,i}$ and the target voltage difference VT, until $\Delta V_{j,i} \leq VT$, and taking $t_0+(k+p+r-1)\Delta t$ as the expected charging time of the sub-pixel in the j-th row and the i-th column, p being taken from 1 and increasing by 1 for each cycle.

2. The method for controlling the charging time of the display panel according to claim 1, further comprising:

during the (k+1)-th blanking time, repeatedly performing: writing the data voltage to a gate of a driving transistor in a sub-pixel in the j-th row and an (i+x)-th column, and at the end of the charging time $t_0+k\Delta t$, detecting a voltage $V_{k_(j,i+x)}$ of a second electrode of the driving transistor in the sub-pixel in the j-th row and the (i+x)-th column, wherein x varies with each repetition to obtain a voltage of a second electrode of a driving transistor in each sub-pixel in the j-th row during the (k+1)-th blanking time, x being an integer not equal to 0;

during the (k+1+r)-th blanking time, repeatedly performing: writing the data voltage to the gate of the driving transistor in the sub-pixel in the j-th row and the (i+x)-th column, and at the end of the charging time $t_0+(k+r)\Delta t$, detecting a voltage $V_{k+1_(j,i+x)}$ of the second electrode of the driving transistor in the sub-pixel in the j-th row and the (i+x)-th column, wherein x varies with each repetition to obtain a voltage of a second electrode of a driving transistor in each sub-pixel in the j-th row during the (k+1+r)-th blanking time;

repeatedly performing: obtaining a voltage difference $\Delta V_{j,i+x}=V_{k+1_(j,i+x)}-V_{k_(j,i+x)}$ of the second electrode of the driving transistor in the sub-pixel in the j-th row and the (i+x)-th column between two adjacent blanking times, comparing the voltage difference $\Delta V_{j,i+x}$ with the target voltage difference VT, if $\Delta V_{j,i+x} \leq VT$, taking $t_0+k\Delta t$ as an expected charging time of the sub-pixel in the j-th row and (i+x)-th column; if $\Delta V_{j,i+x} > VT$, cyclically performing: assigning k+p to k, detecting a voltage $V_{k+p+1_(j,i+x)}$ of the second electrode of the driving transistor in the sub-pixel in the j-th row and the (i+x)-th column, obtaining $\Delta V_{j,i+x}=V_{k+p+1_(j,i+x)}-V_{k+p_(j,i+x)}$, comparing $\Delta V_{j,i+x}$ with the target voltage difference VT, until $\Delta V_{j,i+x} \leq VT$, and taking $t_0+(k+p+r-1)\Delta t$ as the expected charging time of the sub-pixel in the j-th row and the (i+x)-th column, wherein p is taken from 1, and increases by 1 for each cycle, and x varies with each repetition to obtain expected charging times of all sub-pixels in the j-th row; and obtaining a maximum value $T_{jmax}$ of expected charging times of all sub-pixels in the j-th row as an expected charging time for all sub-pixels in the j-th row.

3. The method for controlling the charging time of the display panel according to claim 2, further comprising:

when obtaining the expected charging times of all sub-pixels in the j-th row, obtaining expected charging times of all sub-pixels in each of M rows except for the j-th row; and for each of the M rows except for the j-th row, obtaining a maximum value of the expected charging times of all sub-pixels in the row as an expected charging time for all sub-pixels in the row.

4. The method for controlling the charging time of the display panel according to claim 3, further comprising:

storing the expected charging time for the sub-pixels in each row; and during a blanking time, obtaining at least the expected charging time $T_{jmax}$ for the sub-pixels in the j-th row and at a beginning of the $T_{jmax}$, inputting the data voltage to a gate of the driving transistor in each sub-pixel in the j-th row.

5. The method for controlling the charging time of the display panel according to claim 2, further comprising:

during the (k+1)-th blanking time, obtaining a voltage of a second electrode of a driving transistor in each sub-pixel in each of 1st row to q-th row among the M rows except for the j-th row, wherein $j \leq q < M$, $q \geq 0$, and q is a positive integer;

during the (k+1+r)-th blanking time, obtaining a voltage of the second electrode of the driving transistor in each sub-pixel in each of 1st row to q-th row among the M rows except the j-th row;

for each sub-pixel in each of 1st row to q-th row among the M rows except for the j-th row, obtaining an expected charging time of the sub-pixel; obtaining a maximum value of expected charging times of all sub-pixels in each row of the rows 1 to q except the j-th row as an expected charging time for all sub-pixels in the row;

during a (k+2)-th blanking time, obtaining a voltage of a second electrode of a driving transistor in each sub-pixel in each of (q+1)-th row to M-th row;

during a (k+2+r)-th blanking time, obtaining a voltage of the second electrode of the driving transistor in each sub-pixel in each of (q+1)-th row to M-th row; and for each sub-pixel in each of (q+1)-th row to M-th row, obtaining an expected charging time of the sub-pixel, and obtaining a maximum value of expected charging times of all sub-pixels in each row of (q+1)-th row to M-th row as an expected charging time for all sub-pixels in the row.

6. The method for controlling the charging time of the display panel according to claim 5, further comprising:

storing the expected charging time for the sub-pixels in each row; and during a blanking time, obtaining at least the expected charging time $T_{jmax}$ for the sub-pixels in the j-th row and at a beginning of the $T_{jmax}$, inputting the data voltage to a gate of the driving transistor in each sub-pixel in the j-th row.

7. The method for controlling the charging time of the display panel according to claim 1, further comprising:

during each blanking time for detecting a voltage of the second electrode of the driving transistor, and before the charging time T, writing a reset voltage to the second electrode of the driving transistor.

8. The method for controlling the charging time of the display panel according to claim 1, wherein the target voltage difference VT is 0 to 3 V.

9. A non-transitory computer readable medium having a computer program stored thereon, wherein the method according to claim 1 is implemented when the computer program is executed.

10. An electronic apparatus, comprising a processor and a memory; wherein the memory is configured to store one or more programs;

the processor is configured to execute the one or more programs; when the one or more programs are executed by the processor, the method according to claim 1 is implemented.

11. The electronic apparatus according to claim 10, further comprising a display panel; wherein the display panel includes sub-pixels arranged in M rows and N columns, $M \geq 1$, $N \geq 1$, M and N are positive integers, and each sub-pixels includes:

a light-emitting device;

a driving transistor, a second electrode of the driving transistor being electrically connected to an anode of the light-emitting device;

a sensing transistor, a first electrode of the sensing transistor being electrically connected to the second electrode of the driving transistor;

a sensing signal line electrically connected to a second electrode of the sensing transistor; and a sensing capacitor, one end of the sensing capacitor being electrically connected to the sensing signal line and another end of the sensing capacitor being grounded; and the electronic apparatus further includes a source driving chip, wherein the source driving chip is electrically connected to the sensing signal line and the processor, and the source driving chip is configured to detect a voltage of the second electrode of the driving transistor during a blanking time according to a capacitance of the sensing capacitor at an end of an expected charging time.

12. The electronic apparatus according to claim 11, wherein the sub-pixel further includes:

a writing transistor, a first electrode of the writing transistor being configured to receive a data voltage and a second electrode of the writing transistor being electrically connected to a gate of the driving transistor;

a storage capacitor, an end of the storage capacitor being electrically connected to the gate of the driving transistor, and another end of the storage capacitor being electrically connected to the second electrode of the driving transistor.

13. The electronic apparatus according to claim 11, wherein the sub-pixel further comprises a reset switch; wherein one end of the reset switch is electrically connected to the sensing signal line, and another end of the reset switch is electrically connected to a reset voltage terminal, the reset voltage terminal being configured to receive a reset voltage.

14. The electronic apparatus according to claim 11, wherein sub-pixels in a same column are connected to a same sensing signal line.

15. The electronic apparatus according to claim 11, wherein the light-emitting device is an organic light-emitting diode or a micro light-emitting diode.

* * * * *